US011359381B2

(12) United States Patent
Sieder et al.

(10) Patent No.: US 11,359,381 B2
(45) Date of Patent: Jun. 14, 2022

(54) PANEL

(71) Applicant: AKZENTA PANEELE + PROFILE GMBH, Kaisersesch (DE)

(72) Inventors: Andreas Sieder, Ludwigsfelde (DE); Eberhard Herrmann, Wismar (DE); Carsten Buhlmann, Rangsdorf (DE)

(73) Assignee: AKZENTA PANEELE + PROFILE GMBH, Kaisersesch (DE)

( * ) Notice: Subject to any disclaimer, the term of this patent is extended or adjusted under 35 U.S.C. 154(b) by 0 days.

(21) Appl. No.: 16/972,270

(22) PCT Filed: Mar. 26, 2020

(86) PCT No.: PCT/EP2020/058468
§ 371 (c)(1),
(2) Date: Dec. 4, 2020

(87) PCT Pub. No.: WO2020/200988
PCT Pub. Date: Oct. 8, 2020

(65) Prior Publication Data

US 2021/0238863 A1 Aug. 5, 2021

(30) Foreign Application Priority Data

Mar. 29, 2019 (DE) ..... 20 2019 101 807.0

(51) Int. Cl.
*E04F 13/08* (2006.01)
*E04F 15/02* (2006.01)

(52) U.S. Cl.
CPC .... *E04F 13/0894* (2013.01); *E04F 15/02033* (2013.01); *E04F 15/02038* (2013.01);
(Continued)

(58) Field of Classification Search
CPC ..... E04F 13/0894; E04F 2201/0146; E04F 2201/0161; E04F 2201/043;
(Continued)

(56) References Cited

U.S. PATENT DOCUMENTS 2,328,051 A * 8/1943 Bull ..... E04B 2/7457 52/489.2
6,216,409 B1 * 4/2001 Roy ..... E04F 15/04 52/592.4

(Continued)

FOREIGN PATENT DOCUMENTS

CA 2409410 A1 11/2001
CN 107938992 A 4/2018

(Continued)

*Primary Examiner* — Brent W Herring
(74) *Attorney, Agent, or Firm* — Lucas & Mercanti, LLP; Klaus P. Stoffel

(57) ABSTRACT

A panel having a panel surface and an edge pair of mutually opposite complementary panel edges provided with complementary locking elements. The complementary locking elements are configured such that, when two panels are assembled, both a locking action of the panel edges in a direction perpendicular to the panel surface and a locking action preventing the panels from moving apart is achieved underneath a visible joint by the assembled complementary locking elements. The panel edges with the locking elements have an upper portion and a lower portion, relative to thickness of the panel. The locking elements are arranged and configured in the lower portion. The upper portion forms the upper joint region, including the visible part of the joint. The upper portion on each panel edge of the edge pair has a chamfer which, when two panels are assembled, forms a depressed joint. The chamfers of the complementary panel edges are different sizes in the upper portion. When two complementary panel edges are assembled, the larger cham-
(Continued)

fer is covered by the smaller chamfer. A butt-joint abutment surface is provided on a lower end of the larger chamfer.

28 Claims, 7 Drawing Sheets

(52) U.S. Cl.
CPC ..... *E04F 2201/0146* (2013.01); *E04F 2201/0161* (2013.01); *E04F 2201/041* (2013.01); *E04F 2201/043* (2013.01); *E04F 2201/0535* (2013.01)

(58) Field of Classification Search
CPC ..... E04F 2201/0535; E04F 15/02038; E04F 2201/041; E04F 15/02033
USPC ..... 52/589.1, 591.1, 592.1, 592.2, 592.3
See application file for complete search history.

(56) References Cited

U.S. PATENT DOCUMENTS

| | | | | |
|---|---|---|---|---|
| 6,385,936 | B1 * | 5/2002 | Schneider | E04F 15/02 52/592.1 |
| 6,715,253 | B2 * | 4/2004 | Pervan | E04F 15/04 52/578 |
| 7,386,963 | B2 * | 6/2008 | Pervan | E04F 15/02 52/578 |
| 7,444,791 | B1 * | 11/2008 | Pervan | E04F 15/02 52/590.2 |
| 7,984,600 | B2 * | 7/2011 | Alford | E04F 15/087 52/588.1 |
| 8,261,508 | B2 * | 9/2012 | Thiers | E04F 15/02033 52/592.1 |
| 8,966,853 | B2 | 3/2015 | Hannig | |
| 9,151,062 | B2 * | 10/2015 | Cappelle | E04F 15/04 |
| 10,113,318 | B2 * | 10/2018 | Cappelle | B65B 11/004 |
| 10,233,655 | B2 * | 3/2019 | Meersseman | B32B 3/06 |
| 10,472,833 | B2 | 11/2019 | Loncke | |
| 2002/0020127 | A1 * | 2/2002 | Thiers | E04F 15/102 52/403.1 |
| 2006/0064940 | A1 * | 3/2006 | Cappelle | E04F 15/02 52/589.1 |
| 2011/0011026 | A1 * | 1/2011 | Cappelle | E04F 15/02 52/588.1 |
| 2011/0146188 | A1 * | 6/2011 | Wallin | E04F 15/04 52/588.1 |
| 2013/0133281 | A1 | 5/2013 | Cappelle | |
| 2017/0016235 | A1 * | 1/2017 | Han | E04F 15/02033 |
| 2019/0003188 | A1 * | 1/2019 | Loebel | E04F 15/0215 |

FOREIGN PATENT DOCUMENTS

| | | | | |
|---|---|---|---|---|
| DE | 60100600 | T2 | 7/2004 | |
| DE | 202014010455 | U1 * | 8/2015 | E04F 13/0894 |
| DE | 202014010455 | U1 | 8/2015 | |
| DE | 202015104084 | U1 | 8/2015 | |
| EP | 1415056 | B1 | 1/2006 | |
| JP | 2009197568 | A | 9/2009 | |
| WO | 9747834 | A1 | 12/1997 | |
| WO | WO-2004079130 | A1 * | 9/2004 | B32B 21/10 |
| WO | 2008053333 | A2 | 5/2008 | |
| WO | 2011087425 | A1 | 7/2011 | |
| WO | 2017001976 | A1 | 1/2017 | |
| WO | WO-2017013222 | A1 * | 1/2017 | E04F 15/181 |
| WO | 2017187298 | A2 | 11/2017 | |
| WO | WO-2021105798 | A1 * | 6/2021 | E04F 15/02038 |

* cited by examiner

PRIOR ART 3
1'
2'
5
4

PANEL

CROSS-REFERENCE TO RELATED APPLICATIONS

The present application is a 371 of International application PCT/EP2020/058468, filed Mar. 26, 2020, which claims priority of DE 20 2019 101 807.0, filed Mar. 29, 2019, the priority of these applications is hereby claimed and these applications are incorporated herein by reference.

BACKGROUND OF THE INVENTION

The invention concerns a panel comprising a panel core, a panel top side, a panel underside and at least one edge pair of mutually opposite complementary panel edges provided with complementary locking means, wherein the complementary locking means are of such a configuration that in the assembled state of two of those panels beneath a visible join by means of the assembled complementary locking means both a locking action of the panel edges can be achieved in a direction perpendicular to the panel top side and also a locking action can be achieved to prevent the panels from moving apart and more specifically away from each other within the panel plane in a direction perpendicular to the locked panel edges, with the proviso that the panel edges provided with the complementary locking means have an upper portion and a lower portion in relation to the thickness of the panel, wherein the complementary locking means are arranged and formed in the lower portion of the panel edges, wherein the upper portion of the panel edges is provided for the formation of the upper join region including the visible part of the join and for that purpose the upper portion at each panel edge of the edge pair has an edge break which in the assembled state of two of said panels forms a recessed join, wherein the edge breaks of the complementary panel edges are of different sizes in the upper portion of the panel edges, and in the assembled state of two complementary panel edges the larger edge break is covered by the smaller edge break.

The assembled state of panels or complementary panel edges is basically used to mean the target or reference state.

WO 97/47834 A1 discloses a panel which in the upper portion has a join configuration without a recess and in the lower portion has positively locking fixing means in the form of a groove profile and a tongue profile. WO 2008/053333 discloses an example of a panel having complementary panel edges which in an upper portion relative to the thickness of the panel have a configuration with edge breaks or bevels of differing sizes in the form of a larger chamfer and a smaller chamfer. In that state of the art the upper portions of the panel edges are further of such a configuration that two of those panels in the assembled state form a V-join, wherein the larger chamfer is partially covered by the smaller chamfer. In addition that state of the art defines a neutral position of the panel edges relative to each other, out of which the panel edges can move closer towards each other or further away from each other. In the neutral position the V-join is not closed at its join base, but a gap remains there.

The configuration of the upper portion of the panel edge, known from that state of the art, is deemed to be inappropriate because of the open nature of the join. Dirt and moisture can easily penetrate to the panel core.

The complementary locking means provided in the same state of the art in the lower portion of the complementary panel edges appear less able to carry a load and they are of unsatisfactory durability.

SUMMARY OF THE INVENTION

The object of the invention is to propose a panel which in the upper portion of the panel edges is of an improved configuration with edge breaks.

According to the invention that object is attained in that an obtuse butting surface is provided at a lower end of the larger edge break.

The two edge breaks can be in the form of a bevel or chamfer, a radius or a hollow fillet and so forth.

Desirably provided in the upper portion of the panel edges at that panel edge having the smaller edge break is a counterpart butting surface cooperating with the obtuse butting surface, that is provided beneath the larger edge break.

In addition the pairing provided in the upper portion of the panel edges and comprising the obtuse butting surface and the counterpart butting surface cooperates with the locking means which are arranged in the lower portion of the panel edges and with which the locking action to prevent the panels from moving apart within the panel plane and perpendicularly to the locked panel edges is implemented. More specifically desirably the locking means disposed in the lower portion are so designed that the obtuse butting surface can be held in contact with the counterpart butting surface. In that way the closed nature of the join, that is wanted in the upper portion of the panel edge, is promoted by the locking means disposed in the lower portion.

The panel edge having the smaller of the two edge breaks has beneath that smaller edge break an undercut counterpart surface for the covered part of the larger edge break. Desirably the covered part of the larger edge break is in surface contact with the undercut counterpart surface. That also enhances the closed nature of the join and resists the ingress of dirt and moisture.

An advantageous development provides that the counterpart butting surface provided beneath the smaller edge break is of such a configuration that it has an oversize in an upper region. By virtue thereof, in the assembled state of two panels, pressing with the butting surface of the complementary panel edge can be produced at the upper region of the counterpart butting surface.

The advantage can be further improved if the obtuse butting surface and the counterpart butting surface are so arranged that in the assembled state of two complementary panel edges a wedge-shaped gap is formed between the obtuse butting surface and the counterpart butting surface, such that the tip of the wedge-shaped gap faces upwardly towards the panel top side. The wedge-shaped gap between the butting surface and the counterpart butting surface promotes a relative movement of two assembled locked panels. The panels can involve a kink as a pivot point along the locked panel edges if for example they lie on an uneven surface. In that case locked panels can assume a position relative to each other, in which their panel surfaces are at an angle >180° relative to each other. In that case the wedge-shaped gap within the locked panel edges provides space for the required angular movement of the panel edges. The obtuse butting surface and the counterpart butting surface keep in contact and any opening of the join is counteracted thereby.

To provide a closed join it is advantageous if in the assembled state of two complementary panel edges the obtuse butting surface and the counterpart butting surface are in contact with each other at the tip of the wedge-shaped gap.

The wedge-shaped gap can have a wedge angle in the region of 0° to 10° and preferably 1° to 5° wherein a central axis of the wedge-shaped gap, that halves the wedge angle, is either arranged perpendicularly to the panel surface or is arranged in an angle range of ±5° relative to the perpendicular to the panel top side.

A development provides that in the lower portion of the complementary panel edges the complementary locking means are in the form of complementary hook profiles, namely an upwardly open receiving hook and a downwardly open arresting hook, that both complementary hook profiles have holding surfaces provided integrally on the panel core and by means of which the locking action to prevent the panels moving apart within the panel plane away from each other in a direction perpendicular to the locked panel edges can be achieved and that there is provided a separate locking element for the locking action in the vertical direction perpendicular to the panel top side, as defined in EP 1 415 056 B1 or proposed in WO 2011/087425 A1. Reference is hereby directed to the examples of the configuration for separate locking elements and the arrangement thereof on a panel, as defined in the two above-mentioned publications, and that technical teaching is incorporated herein.

In addition the separate locking element can be mounted at one of the complementary panel edges and can have a latching means with which it is latchable in a latching contour of the complementary panel edge.

Another technical solution as the above-mentioned locking means with hook profiles manages without a separate locking element and provides that provided in the lower portion of the complementary panel edges are locking means including a groove profile and a complementary tongue profile, the groove profile and the complementary tongue profile have holding surfaces, by means of which the locking action preventing the panels from moving apart within the panel plane away from each other in a direction perpendicular to the locked panel edges can be achieved and the tongue profile at its tongue top side has a contact surface and the groove profile at an upper groove wall has a complementary internal surface whereby in the assembled state the locking action can be achieved in the vertical direction perpendicular to the panel top side.

The configuration of the lower portion of the complementary panel edges with locking means, when they are in the form of a groove profile and a complementary tongue profile, as described hereinbefore, is viewed as an independent invention which alternatively can manage without the above-proposed configuration of the upper portion of the complementary panel edges. In the upper portion the panel edges can then be of any configuration, for example it is possible to dispense with any edge break or bevel, so that no recessed join is present at the surface between two locked panels. That equally applies to all developments hereinafter of the panel with a groove profile and a complementary tongue profile.

Desirably the lower groove wall projects distally from the panel edge further than the upper groove wall, wherein a holding edge is provided at the free end of the lower groove wall and the holding surface for the locking action to prevent the panels moving apart in the panel plane is provided at said holding edge.

The groove profile and the tongue profile are adapted for a snap locking action in which locking is effected by level displacement of two identical panels with the panel edges perpendicular towards each other and/or are so adapted that a panel is lockable to an identical panel by a pivotal movement (pivotal locking), in that the panel is fitted in an inclined plane relative to the panel plane of the identical other panel and the tongue profile is lockable by subsequent pivotal movement of the inclinedly fitted panel into the plane of the other panel with its groove profile.

An additional improvement is achieved if one of the holding surfaces for the locking action to prevent level movement of the panels apart is arranged at the lower groove wall of the groove profile and said holding surface is disposed in the region of the lower longer groove wall which extends distally over the length of the upper groove wall, said holding surface is in the form of an inclined plane which drops towards the groove bottom of the groove profile and the holding surface of the tongue profile, that is complementary to the holding surface of the groove profile, at the tongue underside, is also an inclined plane which in the assembled state bears in surface relationship against the holding surface of the groove profile.

Handling can be improved if the groove profile and the tongue profile are adapted for pivotal locking, wherein provided at the tongue underside is a flat lower shoulder surface oriented parallel to the panel top side, the groove profile at a lower groove wall has a contact surface for the shoulder surface of the tongue profile, and wherein the contact surface is also flat and parallel to the panel top side.

For the purposes of good locking in a vertical direction the contact surface on the tongue top side can be parallel to the panel surface and the complementary internal surface of the upper groove wall of the groove profile can be arranged parallel to the panel top side, for that purpose.

The contact surface of the tongue top side has a distal end and a proximal end and likewise the shoulder surface of the tongue underside has a distal end and a proximal end, wherein desirably a spacing is provided between the distal end of the shoulder surface and the proximal end of the contact surface (pivotal connection).

For improving stability of the groove profile the lower groove wall rises out of the plane of the contact surface towards the groove bottom.

An alternative provides that the groove profile and the tongue profile are adapted for snapping locking, wherein at its tongue underside the tongue profile has a proximal lower shoulder surface and distally (near the free end of the tongue profile) it has a carrying surface, the complementary groove profile has a support surface for supporting the carrying surface of the tongue profile at the lower groove wall, and the complementary groove profile is provided with a matching contact surface for the lower shoulder surface of the tongue profile. With the concept of the snap locking action in respect of two panels the panel edges with the groove profile and the tongue profile are moved towards each other with a translatory movement in a direction perpendicular to the longitudinal extent of the complementary panel edges. In order in that case to be able to produce a positively locking connection between the tongue profile and the groove profile those locking means must permit and be able to endure adequate elastic deformation.

The carrying surface of the tongue profile and also the associated support surface of the groove profile are desirably arranged parallel to the panel top side. In that case the support surface is desirably arranged in a region of the lower groove wall, that is opposite to the upper groove wall. If the panel top side in the region of locked panel edges is subjected to a load which exerts a pressure on the upper groove wall then the force is transmitted by way of the internal surface of the upper groove wall to the contact surface of the tongue top side and through the tongue profile. At the tongue underside the force is transmitted from the carrying surface thereof into the support surface of the lower groove wall which in turn carries the force downwardly into a surface on which the panel is lying.

The contact surface provided on the groove profile for the lower shoulder surface of the tongue profile can be arranged in the region of the lower groove wall, that projects distally further from the panel edge with respect to the upper groove wall.

The contact surface provided for the lower shoulder surface of the tongue profile on the groove profile is desirably flat. It can also be formed with an inclination directed downwardly in the distal direction. The inclination is preferably in an angular range of 2° to 10° with respect to the panel top side. The reason for the inclination is in conjunction with the configuration which has the lower groove wall in the region of its free end, as described in greater detail hereinafter.

For the configuration of the panel, that is provided for the purposes of a snapping connection, the contact surface at the tongue top side is desirably arranged parallel relative to the panel top side, wherein the internal surface complementary thereto of the upper groove wall of the groove profile is then also arranged parallel to the panel top side, and wherein the internal surface of the upper groove wall is larger than the support surface at the lower groove wall. Equally the carrying surface at the tongue underside is smaller than the contact surface at the tongue top side. Therefore a force applied from the panel top side is transmitted downwardly into the tongue profile from the upper groove wall by way of a first surface pair. The first surface pair comprises the internal surface of the upper groove wall and the contact surface of the tongue top side. The force from the tongue profile is then further transmitted downwardly by means of a second surface pair comprising the carrying surface of the tongue underside and the support surface of the lower groove wall. The size of the contact surface of the second surface pair is less than the size of the contact surface of the first surface pair. The reduced contact surface of the second surface pair is responsible for the improvement in the strength of the lower groove wall.

Preferably the centre of the internal surface of the upper groove wall is arranged closer to the groove bottom than the centre of the support surface of the lower groove wall. That also serves to enhance the strength of the lower groove wall.

At the inside of the upper groove wall towards the free end thereof the groove profile can have a cut-free relief portion which preferably has an inclined relief surface. In that arrangement the relief portion is desirably so adapted that the width of the groove profile increases towards the free end and forms an enlarged entry opening. The entry opening which is enlarged in that way of the groove profile acts for a tongue profile which is moved with a translatory movement in the direction of the groove profile, like a funnel. The tongue profile then first comes into contact with the relief surface at its tongue top side.

The free end of the tongue profile can be in the form of an obtuse wedge-shaped cross-section, wherein the wedge surface promotes guidance and centring along the inclined relief surface of the upper groove wall to facilitate insertion of the tongue profile into the groove profile.

The wedge surface at the tongue underside is longer and provides a larger cut-free relief portion than the wedge surface at the tongue top side. The relief portion at the tongue underside serves to provide space for the lower groove wall which is to be reinforced by the lower groove wall being of an increasing wall thickness towards the groove bottom.

That holding edge which is provided at the free end of the lower groove wall is desirably provided with an edge surface arranged at a level which makes it possible for implementing a snapping connection to slidingly move the tongue underside of a complementary panel over the edge surface and in so doing bring the tongue top side of the tongue profile into contact with the relief portion at the inside of the upper groove wall. The tongue top side is supported by the contact at the upper groove wall, which benefits the further joining movement. In the further joining movement the tongue profile is moved forwardly deeper into the groove profile, in which case the shoulder surface of the tongue profile presses against the edge surface of the holding edge of the lower groove wall and bends the lower groove wall elastically downwardly in the direction of the panel underside. The tongue profile is supported at the tongue top side at the inside of the strong upper groove wall. By virtue of its smaller distal extent the upper groove wall is less yielding than the lower groove wall. In addition the wall thickness of the upper groove wall is greater than that of the lower groove wall, which promotes the desired higher stiffness of the upper groove wall in comparison with the lower groove wall.

In addition the edge surface is desirably provided with an inclination adapted to the inclination of the shoulder surface of the tongue underside, or is identical to the inclination of the contact surface of the lower groove wall. This ensures that, at the beginning of the translatory joining movement, the shoulder surface of the tongue underside is in surface contact with the edge surface and pressure can be uniformly applied to the edge surface to begin elastic bending of the lower groove wall.

The tongue underside can have a concave contour between its carrying surface and its shoulder surface, wherein in the assembled state of two panels a free space is formed between the concave contour and the lower groove wall. The concave contour benefits the beginning of the joining movement. It is known from the state of the art that, for the beginning of the joining movement, firstly the tongue underside is only placed on the holding edge. It has now been found in that respect that the tongue underside can be so inappropriately inclined that it can already slip off entirely at the beginning of the joining movement when it has only been laid on the edge surface of the holding edge. In the case of a long panel it may be difficult to lay the tongue underside correctly on the holding edge over the entire length of the panel. The concave contour in that region at the tongue underside makes it easier to simply and securely place the tongue profile on the holding edge and to prevent it from slipping off the holding edge.

Furthermore, by virtue of the concave contour at the tongue underside, there is a free space towards the lower groove wall. The free space makes it easier for the surface pairing comprising the carrying surface and the support surface to bear against each other and at the same time for the pairing comprising the shoulder surface and the contact surface to bear against each other in surface contact. The free space further leaves space for particles which can occur everywhere on the lower groove wall. Such particles could interfere with fitment of the above-mentioned surface pairing and adversely affect the functionality of the locking configuration.

In the assembled state of two complementary panel edges at least three pairings of contact surfaces can be formed between the groove profile and the tongue profile. A contact surface pairing comprises the contact surface of the tongue top side paired with the internal surface of the upper groove wall. At least one second contact surface pairing comprises the shoulder surface of the tongue underside paired with the contact surface of the lower groove wall. A third contact surface pairing can comprise the carrying surface of the tongue underside paired with the support surface of the lower groove wall. In the assembled state of two panels a free space is formed between each of said contact surface pairings.

For a panel with a lower groove wall which, by virtue of its wall thickness, would be excessively non-yielding for making a snapping connection a slot can be provided beneath the groove bottom of the groove profile in the region of the proximal end of the lower groove wall at the panel underside, which slot extends parallel to the panel edge to increase the yielding flexibility of the lower groove wall. Desirably the slot has a rounded bottom, which reduces notching stresses. The slot can include parallel side walls or the slot can be of a substantially trapezoidal cross-section.

BRIEF DESCRIPTION OF THE DRAWING

The invention is illustrated by way of example in a drawing and described in detail by means of a number of embodiments. In the drawing.

DETAILED DESCRIPTION OF THE INVENTION

Figure 1:
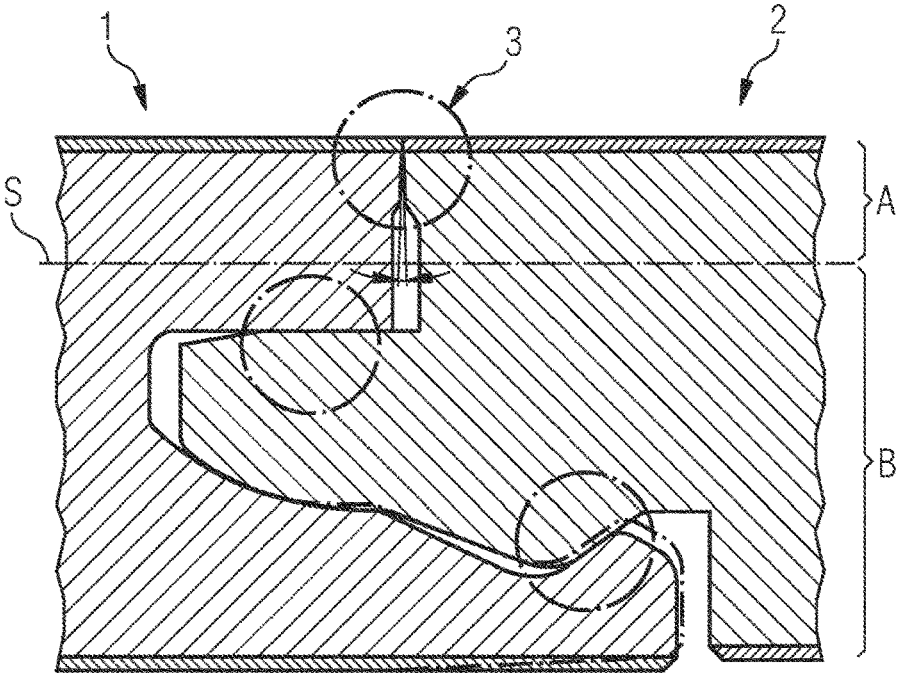
FIG. 1 shows a panel according to the state of the art.
Figure 2:
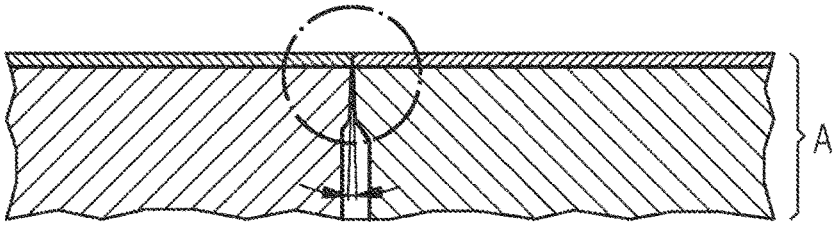
FIG. 2 shows an upper portion of the known panel of FIG. 1.
Figure 3:
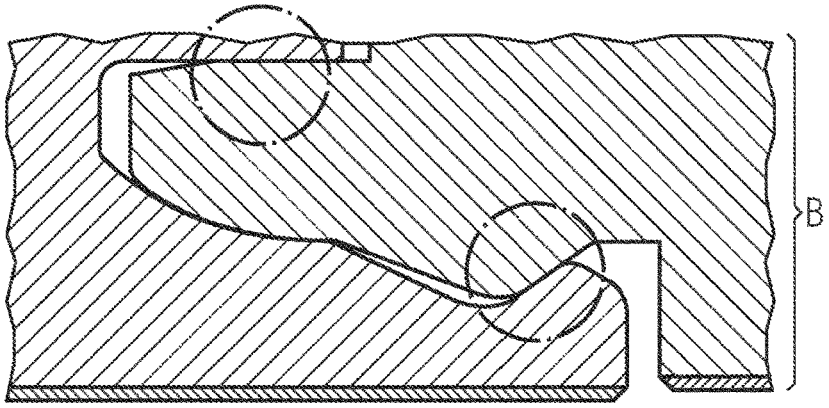
FIG. 3 shows a lower portion of the known panel of FIG. 1.

FIGS. 1 to 3 show portion-wise a panel in accordance with the state of the art in WO 97/47834 A1. FIG. 1 shows the panel edges 1 and 2 of two panels 1' and 2' in the assembled state. The panel edges are locked in positively locking relationship. The subdivision of the panel edges into an upper portion A and a lower portion B is indicated in FIG. 1 by a horizontal dash-dotted line S. The configuration of a join 3 is to be seen in the upper portion A; this state of the art dispenses with a recessed join. Instead a continuously flat overall surface is formed at the mutually adjoining panel edges 1 and 2.

FIG. 2 shows only the upper portion A of the panel edges 1 and 2 in FIG. 1 and FIG. 3 shows only the lower portion B of the panel edges 1 and 2 which here are provided with locking means in the form of a groove profile at the panel edge 1 and a complementary tongue profile at the panel edge 2.

Figure 4:
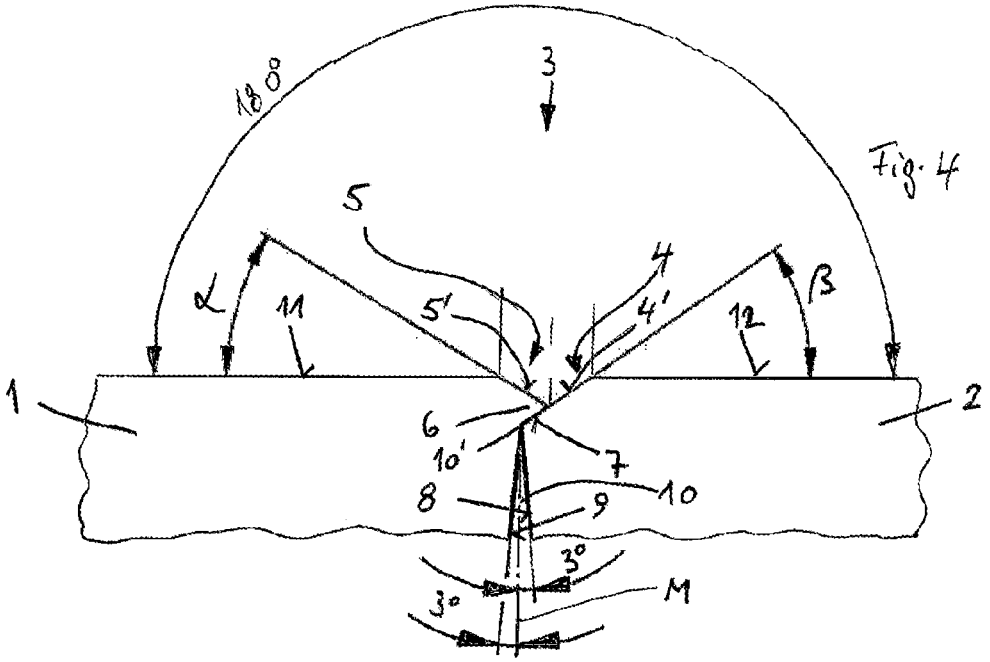
FIG. 4 shows a part of the upper portion of a panel according to the invention or complementary panel edges thereof in a mutually locked state.
Figure 5:
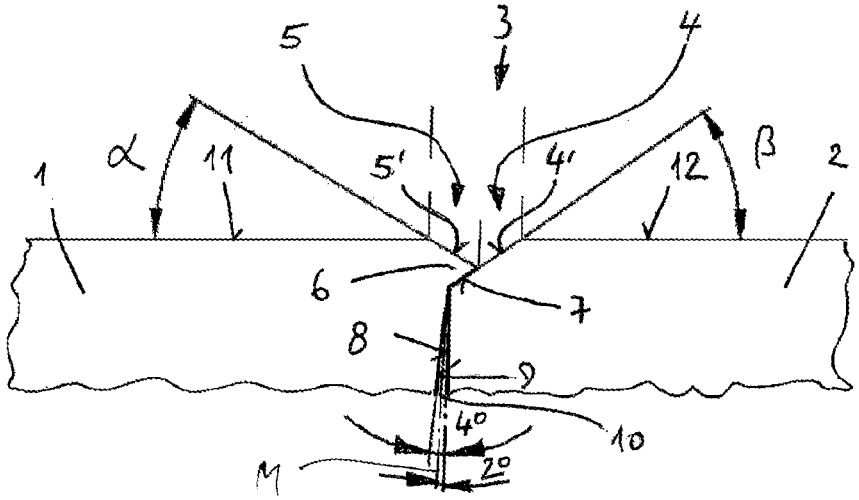
FIG. 5 shows a portion from FIG. 4 with an alternative configuration of the upper portion of a panel according to the invention.
Figure 6:
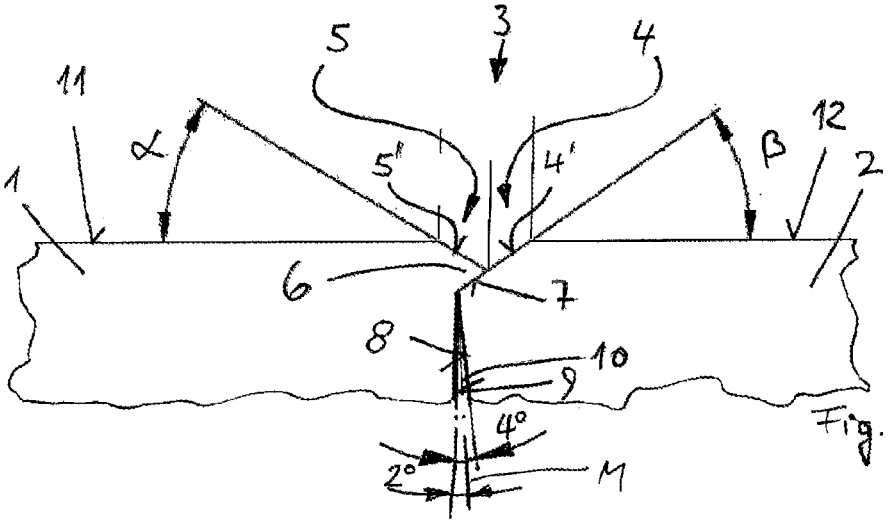
FIG. 6 shows a portion from FIG. 4 with a further alternative configuration of the upper portion of a panel according to the invention.

Embodiments by way of example of the upper portion A are shown by reference to FIGS. 4 to 6 by means of assembled complementary panel edges which give a recessed join 3. Provided at the panel edge 2 shown at the right in FIGS. 4 to 6 is a respective large edge break or bevel 4 in the form of a chamfer 4' which is arranged at an angle $\alpha$ while arranged at the panel edge 1 illustrated at the left is a respective small edge break or bevel 5 in the form of a chamfer 5' at an angle $\beta$. The angles $\alpha$ and $\beta$ can be of the same magnitude or can differ from each other by an amount of ±5°. In the present embodiment the angle $\alpha$=30° and the angle $\beta$ is 35°.

The panel edge 1 with the smaller of the two edge breaks has a wedge-shaped projection 6 at which a counterpart surface 7 of undercut configuration is arranged beneath the smaller edge break or bevel 5. The counterpart surface 7 serves as a contact surface for the covered part of the larger edge break 4. Desirably therefore the covered part of the larger edge break 4 is in contact with the undercut counterpart surface 7. That improves the closed nature of the join 3 and opposes the ingress of dirt and moisture.

Because of the above-mentioned angle $\alpha$=30° of the smaller edge break 5 and the angle $\beta$=35° of the larger edge break 4 this arrangement provides that the counterpart surface 7 always comes into contact at its upper end with the chamfer 4' of the larger edge break 4, which in that way is sealingly closed.

Provided at the panel edge 2 having the larger edge break 4 beneath the edge break is an obtuse butting surface 8. The complementary panel edge 1 having the smaller edge break 5 beneath the wedge-shaped projection 6 or beneath the undercut counterpart surface 7 has a counterpart butting surface 9 which comes into contact with the obtuse butting surface 8 in the assembled state of two complementary panels 1' and 2'. The obtuse butting surface and the counterpart butting surface 9 are so arranged that, in the assembled state of two complementary panel edges, a wedge-shaped gap 10 is formed between the obtuse butting surface 8 and the counterpart butting surface 9. In this arrangement the tip of the gap 10' is directed upwardly towards the panel surface 11/12. That wedge-shaped gap promotes a relative movement of two assembled locked panels. If the locked panel edges 1 and 2 of two panels act as a point of rotation a kink can be formed in the overall surface between the two panels. That occurs for example when the panels 1' and 2' lie on an uneven surface and in particular if the panels lie on a surface with a hump. Then two locked panels can assume a position relative to each other, in which their panel surfaces assume an angle >180° relative to each other. In that case the wedge-shaped gap 10 between the obtuse butting surface and the counterpart butting surface 9 provides for stress relief as it provides space for the required angular movement of the panel edges within the locked panel edges 1 and 2. The obtuse butting surface 8 and the counterpart butting surface 9 maintain contact at their upper ends so that opening of the join is resisted in that way.

In FIG. 4 the wedge-shaped gap 10 has a wedge angle of 6° and is arranged symmetrically relative to the perpendicular to the panel surface. In FIG. 5 the wedge angle is 4° and its central axis M is around +2° out of the perpendicular to the panel surface 11/12. In FIG. 6 the wedge angle is again 4° and its central axis is around −2° from the perpendicular to the panel surface 11/12.

The above embodiments by way of example of the upper portions A of the panel edges with the recessed joins between the mutually adjoining panel edges can be combined in any desired fashion with lower portions B of the panel edges of a different configuration, which are adapted to contribute to the function of affording the positively locking connection.

Figure 7:
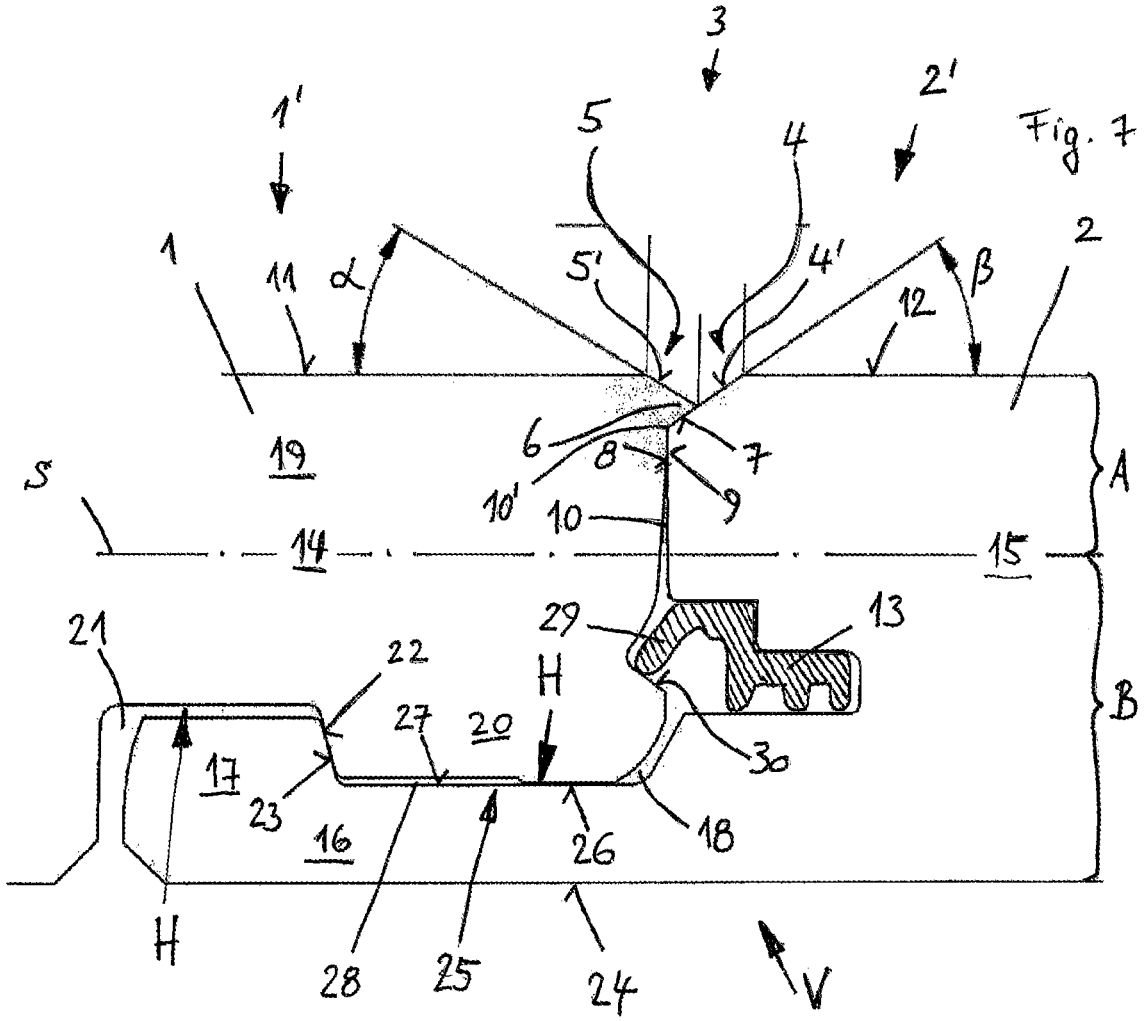
FIG. 7 shows a portion of two complementary panel edges which can be provided on a panel according to the invention.

A first example of a combination of the upper portion A and the lower portion B is shown in FIG. 7. It shows a portion of complementary panel edges 1 and 2 in the assembled locked state. The upper portion A thereof is of the configuration as proposed in FIG. 4, but in that respect it is emphasised that any other configuration of the upper portion is equally possible, for example that in accordance with the state of the art as shown in FIGS. 1 and 2. That applies equally for all embodiments by way of example hereinafter which show developments of the lower portion. In FIG. 7 the lower portion B of the panel edges 1 and 2 is provided with locking means which lock two assembled panel edges in the vertical and horizontal directions. In this embodiment provided for the vertical locking action is a separate locking element 13 which has resilient properties. The separate locking element can be of a configuration like the resilient locking element designs in EP 1 415 056 B1 or in WO 2011/087425 A1.

Referring to FIG. 7 provided for the horizontal locking action in the lower portion B of the panel edges 1 and 2 are complementary hook profiles H which are produced integrally with a panel core 14 or 15 respectively, more specifically a receiving hook 16 having a hook edge 17 and an upwardly open receiving recess 18 as well as an arresting hook 19 which has an arresting shoulder 20 and a downwardly open arresting recess 21. The receiving recess 18 is adapted to receive the arresting shoulder 20 of the arresting hook.

Both hook profiles have a respective holding surface 22 and 23 respectively which are formed integrally on the panel core 14 and 15 respectively and by means of which the locking action to prevent the panels 1' and 2' from moving apart within the plane of the panel away from each other in a direction perpendicular to the locked panel edges can be achieved (horizontal). The receiving hook 16 is towards a panel underside 24 and projects distally from the panel edge 2 at the panel underside. The holding surface 22 of the receiving hook 16 is provided at a proximal side of the hook edge 17. The surface normal of the holding surface is directed towards the panel core 15 of the panel 2'. The arresting hook 19 also has the holding surface 23 at a proximal side of the arresting shoulder 20 and its surface normal is directed towards the panel core 14 of the panel 1'.

In the present example the arresting shoulder 20 at an underside 25 has a distal shoulder surface 26 which contacts a bottom 27 of the receiving recess 18 as well as a proximal material recess 28 which extends laterally to the holding surface 23 of the arresting shoulder 20. The material recess 28 is beneficial to good contact of the holding surface 22/23 of the arresting shoulder 20 and the hook edge 17.

The joining movement for this panel embodiment which is provided with hook profiles H is in a direction perpendicular to the plane of the panel (vertical). The wedge-shaped projection 16 is desirably provided on the arresting hook 19 for the small edge break or bevel 5. The top side of the wedge-shaped projection 6 forms the small edge break or bevel 5 and its underside includes the undercut counterpart surface 7 which serves as a contact surface for the covered part of the larger edge break 4 which is provided on the receiving hook 16.

The separate locking element 13 is mounted only at the panel edge 2 at the beginning of a joining movement. It has a distally projecting latching means 29. The latching means can automatically latch during the joining movement into a lateral latching recess 30 provided on the complementary panel edge 1.

Figure 8:
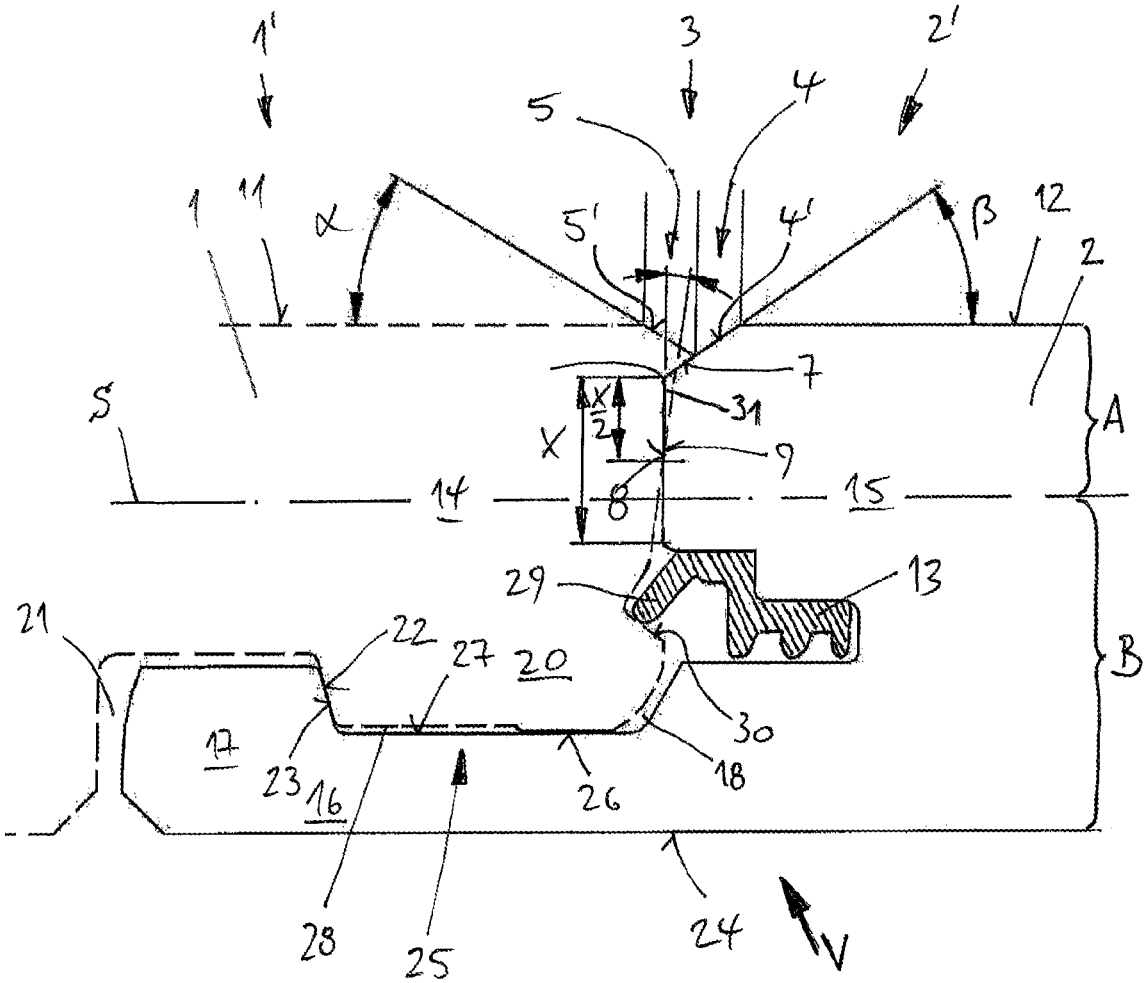
FIG. 8 shows a development of the panel of FIG. 7.

FIG. 8 shows a modification of the above-described embodiment which except for a detail corresponds to the FIG. 7 embodiment. Unlike FIG. 7 in FIG. 8 the counterpart butting surface 9 provided on the arresting hook 19 beneath the smaller edge break 5 has been modified. The cross-section of the entire arresting hook 19 is shown as a broken line in FIG. 8 and illustrates its neutral configuration, as though it were not fitted together with the receiving hook. It is shown in that case that the broken line intersects/covers the cross-section of the complementary receiving hook 16 in the region of the counterpart butting surface 9, more specifically where the hook has its obtuse butting surface 8. The dimension of the overlap 31 is shown exaggerated for better visibility in FIG. 8. In practice the arrangement involves hundreds to a few tenths of a millimetre maximum depth of the overlap 31. The overlap in practice provides for pressure of the assembled panel edges between the butting surface 8 and the counterpart butting surface 9.

The desired pressure occurs in the upper region of the butting surface 8 and the counterpart butting surface 9. For that purpose the configuration is such that the degree of the overlap extends over half the height (X/2) of the region (X) of the panel edges, that the butting surface 8 and the counterpart butting surface 9 assume.

Figure 9:
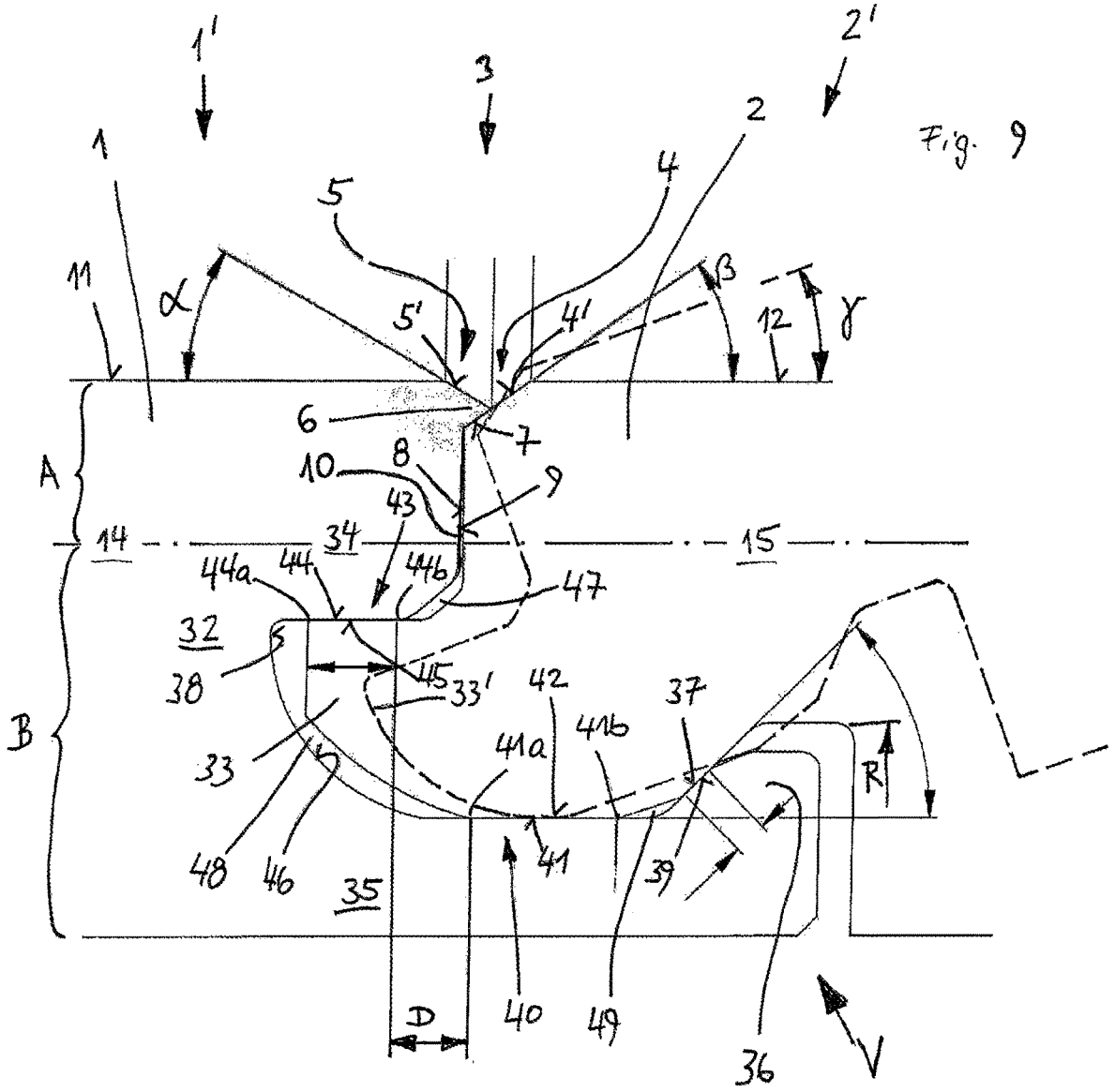
FIG. 9 shows a portion of a further configuration showing two complementary panel edges which are provided for pivotal locking and which can be provided on a panel according to the invention.

A further configuration of a panel according to the invention with complementary panel edges 1 and 2 is shown in FIG. 9. This is a panel in which the lower portion B of the panel edges, that is provided for the locking actions (horizontal/vertical) is provided with a groove profile 32 at the panel edge 1 and with a tongue profile 33 complementary thereto at the panel edge 2. The groove profile 32 has an upper groove wall 34 and a lower groove wall 35. FIG. 9 shows the sections of the two identical panel edges 1 and 2 in the assembled state. In the upper portion A this type of panel involves a configuration as shown in FIG. 4, with a V-join 3 having a large edge break 4 and a small edge break 5, wherein the large edge break 4 is partially covered by the small edge break 5. Here too it is emphasised that any other alternative configuration of the upper portion A can be provided, for example that in accordance with the state of the art as shown in FIGS. 1 and 2. The groove profile 32 and the complementary tongue profile 33 in the lower portion B of the those panel edges are provided for pivotal locking. For pivotal locking the panel 2' with the tongue profile 33 is positioned at a pivotal angle γ in order to insert the free end of the tongue profile 33 between the groove walls 34 and 35 of the groove profile 32, as indicated with the tongue profile 33' illustrated with the broken line in FIG. 9. Then the locking action can be easily implemented by the firstly upwardly pivoted panel being pivoted down into the plane of the panel 1' having the complementary groove profile 32.

The lower groove wall 35 of the groove profile 32 extends distally further from the panel edge 1 than the upper groove wall 34. In addition the lower groove wall 35 has a holding edge 36 at its free end, wherein provided at a proximal side of the holding edge is a holding surface 37 which resists horizontal spreading movement of locked panels. The holding surface 37 is in the form of an inclined plane which drops away towards the groove bottom 38 of the groove profile 32, wherein a holding surface 39 of the tongue profile 33 at the tongue underside 40, being complementary to the holding surface of the groove profile 32, is also in the form of an inclined plane which in the assembled state bears in surface contact against the holding surface 37 of the groove profile. The holding surface 37 of the groove profile therefore has a surface normal directed towards the panel core 14 of the panel 1'. The holding edge 36 of the lower groove wall 35 of the groove profile 32 is also of a height R which does not allow a panel to be moved with the tongue profile 33 leading horizontally over the holding edge 36 and the free end of the tongue profile 33 to be positioned on the way to a snapping locking action between the groove walls 34 and 35 of the groove profile 32.

Provided at the tongue underside 40 is a flat lower shoulder surface 41 oriented parallel to the panel surface 11. In matching relationship therewith the groove profile 32 at its lower groove wall 35 has a flat contact surface 42 for the shoulder surface 41 of the tongue profile 33, which is also flat and oriented parallel to the panel surface 12.

For the purposes of good locking in the vertical direction provided at the tongue top side 43 is a contact surface 44 which in turn is oriented parallel to the panel surface 12. Provided for the surface 44 on the tongue top side there is a complementary internal surface 45 of the upper groove wall 34 of the groove profile, that is arranged parallel to the panel surface 11.

The contact surface 44 of the tongue top side has a distal end 44*a* and a proximal end 44*b*. The shoulder surface 41 of the tongue underside also has a distal end 41*a* and a proximal end 41*b*. As shown in FIG. 9 there is a spacing D between the distal end 41*a* of the shoulder surface and the proximal end 44*b* of the contact surface 44.

To improve the stability of the groove profile 32 the lower groove wall 35 extends out of the plane of the contact surface 42 towards the groove bottom 38 with a rise 46. In the proximal region of the lower groove wall 35, where it extends out of the panel core 14, that increases its wall thickness. The transition from the larger wall thickness of the lower groove wall to the smaller wall thickness is continuous, which also contributes to the strength of the lower groove wall 35.

Within the locking configuration in FIG. 9 it is possible to see pairs of contact surfaces, wherein a respective surface of the groove profile 32 is in contact with an associated surface of the complementary tongue profile 33. In a downward direction through the locking configuration that begins with a first contact surface pairing formed from the obtuse butting surface 8 at the panel edge 2 with the tongue profile 33 and the counterpart butting surface 9 at the panel edge 1 with the groove profile 32. A second contact surface pairing follows in the form of the pairing consisting of the horizontal contact surface 44 of the tongue top side 43 and the internal surface 45 of the upper groove wall 34. There is a free space 47 between the two first-mentioned contact surface pairings. A third contact surface pairing follows in the form of the pairing consisting of the shoulder surface 41 of the tongue underside and the contact surface 42 of the lower groove wall 35. Between the second and the third contact surface pairing there is also a free space 48 which extends at the groove bottom 38 and between the tongue underside and the lower groove wall 35. A fourth contact surface pairing follows, comprising the holding surface 39 provided at the tongue underside and the holding surface 37 at the holding edge 36 of the lower groove wall 35. There is again a free space 49 between the third and the fourth contact surface pairings.

Figure 10:
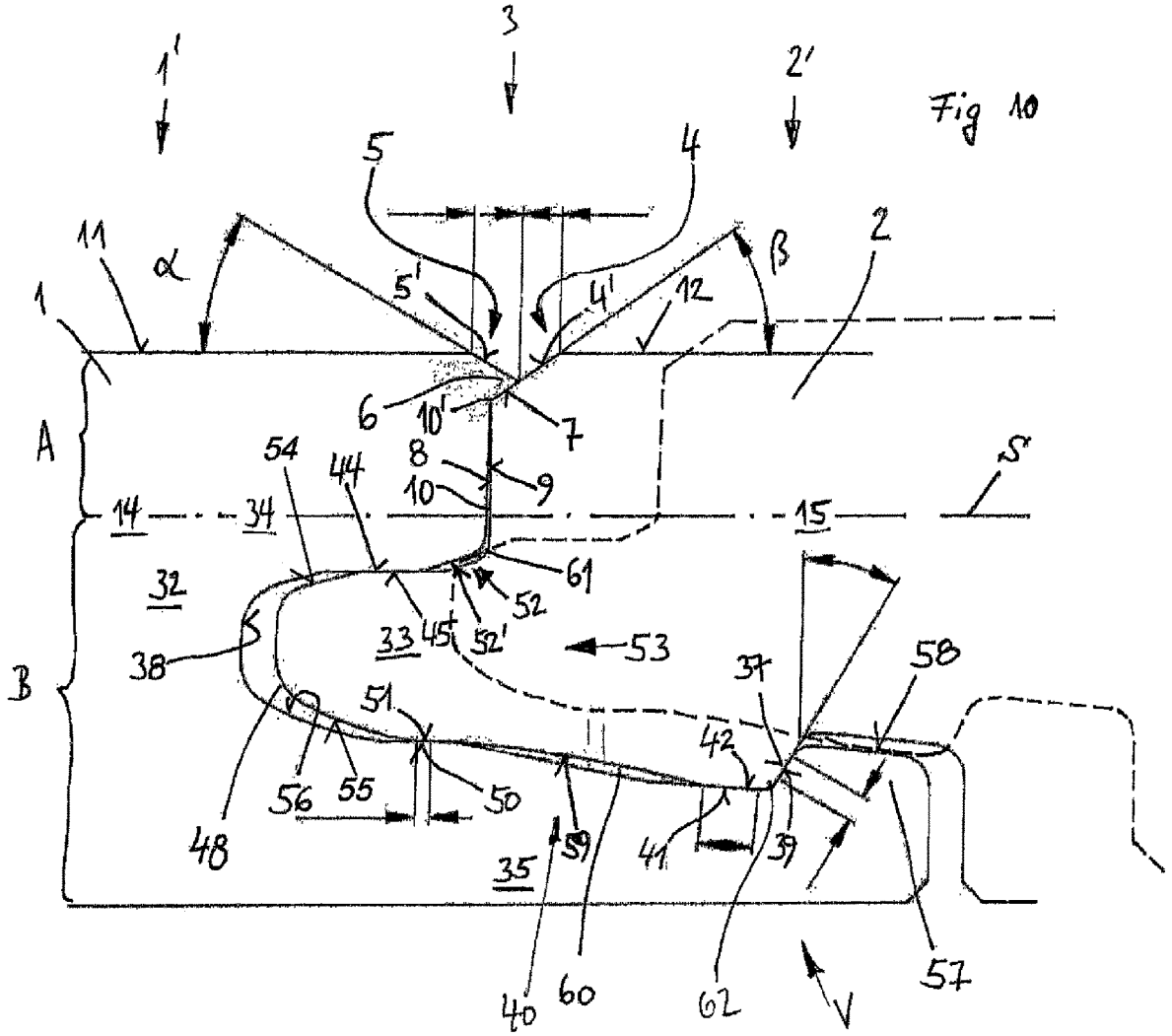
FIG. 10 shows a portion of a further configuration showing two complementary panel edges which are provided for snapping locking and which can be provided on a panel according to the invention.

Yet a further embodiment of the panel according to the invention is shown in FIG. 10. It has a groove profile 32 and a complementary tongue profile 33 which are so designed that they are suitable for a snap locking action in which locking is implemented by a level displacement of two identical panels 1' and 2' with the panel edges 1 and 2 leading towards each other.

The tongue profile 33 in FIG. 10 at its tongue underside proximally has a lower contact surface 41 and distally (near the free end of the tongue profile) a carrying surface 50 is provided on the tongue profile 33. At a lower groove wall 35 the complementary groove profile 32 has a support surface 51 for supporting the carrying surface 50 of the tongue profile. The groove profile 32 has a matching contact surface 42 for the shoulder surface 41 of the tongue profile 33.

For the purposes of good locking in the vertical direction provided at the tongue top side 43 is a contact surface 44 which in turn is oriented parallel to the panel surface 12. Provided for that surface 44 there is a complementary internal surface 45 at the upper groove wall 34 of the groove profile 32, that is arranged parallel to the panel surface.

In order to be able to implement a positively locking connection between the groove profile 32 and the tongue profile 33 when implementing the snapping locking action in particular the groove profile 32 must allow and be capable of sufficient elastic deformation.

The carrying surface 50 of the tongue profile 33 and also the associated support surface 51 of the groove profile 32 are appropriately arranged parallel to the panel surface 11/12. In that case the support surface 51 as shown in FIG. 10 is disposed in a region of the lower groove wall 35, that is opposite the upper groove wall 34.

If there is a load on the panel surface 11 in the region of locked panel edges, that exerts a pressure on the upper groove wall 34, then the force is transmitted to the contact surface 44 of the tongue top side by way of the internal surface 45 of the upper groove wall 34 and passed through the tongue profile 33 downwardly to the tongue underside. At the tongue underside the force is transmitted from the carrying surface 50 thereof to the support surface 51 of the lower groove wall 35 which in turn carries the force further downwardly into a surface on which the panel 1' is resting.

The contact surface 42 on the groove profile 32 for the lower shoulder surface 41 of the tongue profile 33 is arranged in the region of the lower groove wall 35, that projects distally further from the panel edge 1 in relation to the upper groove wall 3.

The contact surface 42 provided for the lower shoulder surface 41 of the tongue profile 33 on the groove profile 32 is of a flat configuration as shown in FIG. 10. It is also formed with an inclination directed downwardly in the distal direction. The inclination is preferably in an angular range of 2° to 10° with respect to the panel surface 11. The reason for the inclination lies in the cooperation with the configuration of the lower groove wall in the region of the free end thereof, as described in greater detail hereinafter.

For the panel shown in FIG. 10 the contact surface 44 at the tongue top side is arranged parallel to the panel surface 11. The complementary internal surface of the upper groove wall 34 of the groove profile 32 is arranged parallel to the panel surface 12.

The internal surface 45 of the upper groove wall 34 which serves for contact with the tongue top side is larger in FIG. 10 than the support surface 51 at the lower groove wall 35, that provides contact with the tongue profile 33 at the tongue underside. Equally the carrying surface 50 at the tongue underside is smaller than the contact surface 44 at the tongue top side.

A force applied from the panel surface is transmitted downwardly into the tongue profile 33 from the upper groove wall 34 by way of a first surface pair. The first surface pair comprises the internal surface 45 of the upper groove wall 34 and the contact surface 44 of the tongue top side. The force is then transmitted further downwardly from the tongue profile 33 by means of a second surface pair consisting of the carrying surface 50 of the tongue underside and the support surface 51 of the lower groove wall 35. The size of the contact surface of the second surface pair is less than the size of the contact surface of the first surface pair. The reduced contact surface of the second surface pair serves to improve the strength of the lower groove wall 35.

Preferably the centre of the internal surface 45 of the upper groove wall 34 is arranged closer to the groove bottom 38 than the centre of the support surface 51 of the lower groove wall 35. That also serves to improve the strength of the lower groove wall 35.

At the inside of the upper groove wall 34 towards the free end thereof the groove profile 32 has a cut-free relief portion 52 which as shown in FIG. 10 is in the form of an inclined relief surface 52'. That relief portion is so arranged that the width of the groove profile 32 increases towards the free end. That forms an enlarged entry opening 53 into the cross-section of the groove profile 32. The enlarged entry opening 53 acts like a funnel for a tongue profile 33 which is moved with a translatory movement in the direction of the groove profile 32. The tongue profile 33 is "funneled" into the groove profile 32. In that case it first comes into contact at its tongue top side with the relief surface 52' of the upper groove wall 34.

The free end of the tongue profile 33 is in the form of an obtuse wedge-shaped cross-section, wherein an upper wedge surface 34 permits guidance and centring along the inclined relief surface 52' of the upper groove wall 34 to facilitate insertion of the tongue profile 33 into the groove profile 32.

The lower wedge surface 55 at the tongue underside is longer and provides a larger relief portion than the upper wedge surface 54. The larger relief portion at the tongue underside serves to provide space for the lower groove wall 35 which in that region has a rise 56 and is thereby reinforced, that is to say the lower groove wall 35 has an increasing wall thickness towards the groove bottom.

Provided at the free end of the lower groove wall 35 is a holding edge 57, the configuration of which is adapted to cooperate well with the shoulder surface 41 of the tongue profile 33.

The holding edge 57 is provided with an edge surface 58 arranged at a level which makes it possible, for providing a snap connection, to move the tongue underside of a complementary panel 2' slidingly over the edge surface 58 and in so doing to bring the tongue top side of the tongue profile 33 into contact with the relief surface 52' at the inside of the upper groove wall 34. The tongue top side is then supported by the contact against the upper groove wall 34, which benefits the further joining movement. In the further joining movement the tongue profile 33 is moved forwardly deeper into the tongue profile 33, in which case the shoulder surface 41 of the tongue profile 33 presses from above against the edge surface 58 of the holding edge 57 of the lower groove wall 35. The lower groove wall 35 is thereby elastically bent downwardly in the direction of the panel underside. The tongue profile 33 is supported at the tongue top side against the inside of the thicker and stronger upper groove wall 34. By virtue of its shorter distal extent the upper groove wall 34 is less yielding than the lower groove wall 35. In addition the wall thickness of the upper groove wall 34 is larger than the wall thickness of the lower groove wall 35, which affords the desired higher stiffness of the upper groove wall 34 in comparison with the lower groove wall 35.

For good cooperation with the shoulder surface 41 which has an inclination of 2° to 10° with respect to the panel surface 11 the edge surface 58 is provided with a suitable inclination matching the inclination of the shoulder surface 41 of the tongue underside, or is identical to the inclination of the contact surface 42 of the lower groove wall 35. This ensures that, at the beginning of the translatory joining movement, the shoulder surface 41 of the tongue underside is in surface contact with the edge surface 58 and pressure can be evenly exerted on the edge surface to begin elastic bending of the lower groove wall 35.

In addition provided at the holding edge proximally there is a holding surface 37 whose surface normal is directed towards the panel core 14. Provided at a proximal surface of the tongue underside of the tongue profile 33 there is a holding surface 39 which in the assembled state shown in FIG. 10 cooperates with the holding surface 37 of the lower groove wall.

Between its carrying surface 50 and its shoulder surface 41 the tongue underside has a concave contour 59. In the assembled state of two panels a free space is formed between the concave contour 59 and the lower groove wall 35. The concave contour benefits the beginning of the joining movement. The tongue underside of the tongue profile can be simply placed on the holding edge without slipping off there right at the beginning of the joining movement.

In addition by virtue of the concave contour at the tongue underside there is a free space 60 towards the lower groove wall. The free space helps to provide that the surface pairing comprising the carrying surface/support surface can bear against each other and at the same time the pairing comprising the shoulder surface/contact surface can also bear in surface contact with each other. In addition the free space provides space for particles which can occur anywhere on the lower groove wall. Such particles could interfere with the contact between the above-mentioned surface pairings and adversely affect the functionality of the locking action.

In the assembled state of two complementary panel edges at least three pairings of contact surfaces are formed in the lower portion B of the panel edges between the groove profile 32 and the tongue profile 33. One contact surface pairing consists of the contact surface 44 of the tongue top side paired with the internal surface 45 of the upper groove wall 34. A second contact surface pairing comprises the shoulder surface 41 of the tongue underside paired with the contact surface 42 of the lower groove wall. There is a free space 48 between the first and second contact surface pairings. A third contact surface pairing comprises the carrying surface 50 of the tongue underside paired with the support surface 51 of the lower groove wall 35. A free space 60 is provided between the second and third contact surface pairings. In addition provided in the region of the relief surface 52' is a free space 61 which transitions from the lower portion B to the upper portion A. A further small free space 62 is provided between the contact surface pairings 41/42 and 37/39. Here there is a radius at the tongue underside between the shoulder surface 41 and the holding surface 39, that radius being somewhat larger than a radius which is formed at the lower groove wall between the contact surface 42 thereof and the holding surface 37 on the holding edge 57. The free space 62 is disposed between the above-mentioned radii of different sizes.

Figure 11:
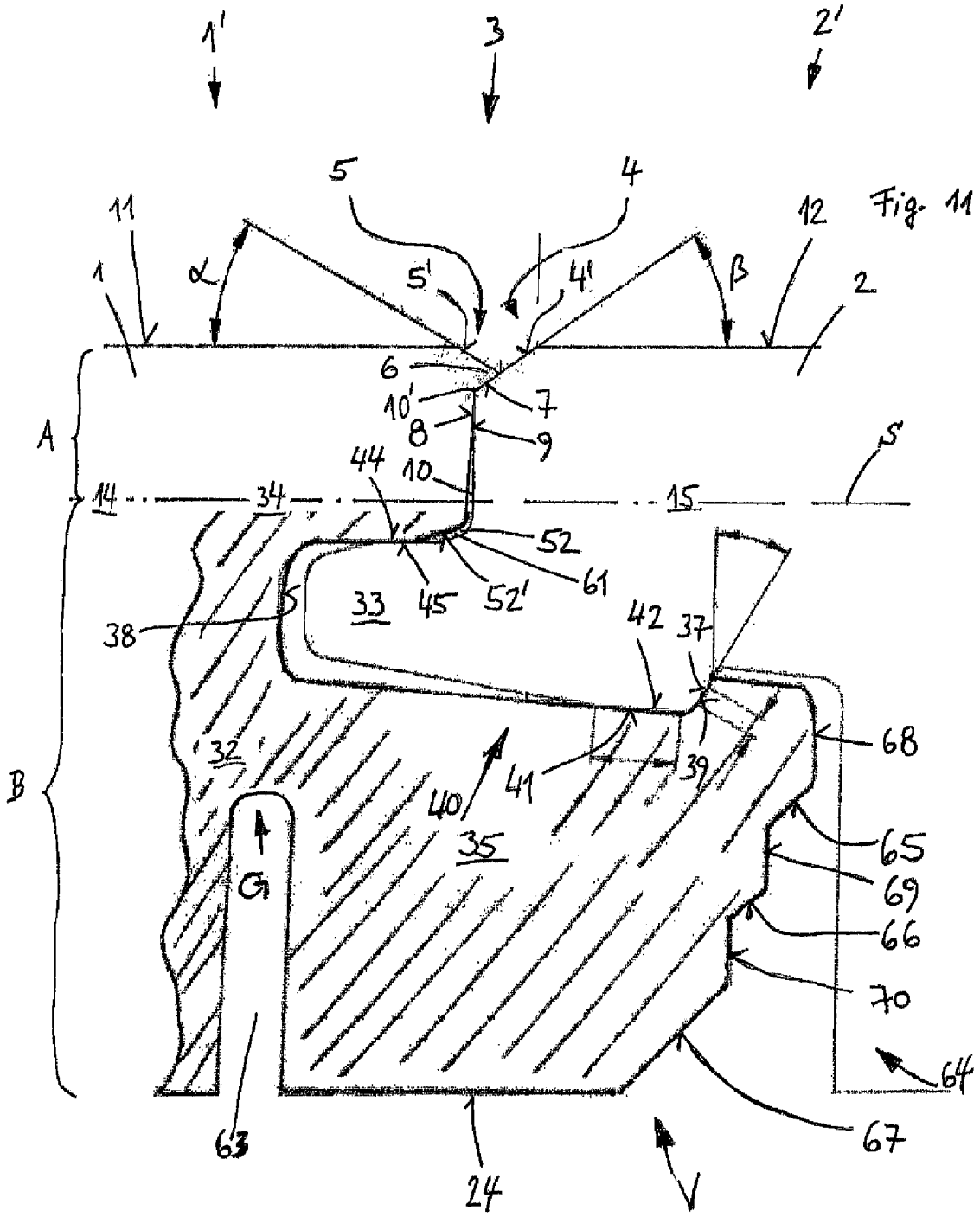
FIG. 11 shows a portion of a further configuration showing two complementary panel edges which are provided for snapping locking and which can be provided on a panel according to the invention.

A further embodiment of the panel according to the invention is shown in FIG. 11. The panel of FIG. 11 is intended to be capable of forming a snapping locking action, just as with the embodiment of FIG. 10. The configuration of the cross-sections of the tongue profile and the groove profile in FIG. 11 differs somewhat from that shown in FIG. 10. It could however also be identical in FIG. 11 to the configuration shown in FIG. 10. The essential difference in FIG. 11 lies in the modified lower groove wall 35 which is thicker and stronger and less yielding than that in FIG. 10.

Below the groove bottom 38 of the groove profile 32 in the region of the proximal end of the lower groove wall 35 there is a slot 64 at the panel underside 24, which increases the yielding flexibility of the lower groove wall 35. The slot 63 extends parallel to the panel edge 1. As a result the yielding flexibility of the lower groove wall 35 is increased to such an extent that snapping locking of the complementary panel edges 1 and 2 is possible. The bottom G of the slot has a rounded cross-section to minimise notch stresses and to counteract cracking.

The free end of the lower groove wall 35 is provided with a stepped contour 64 having a plurality of chamfers 65, 66 and 67. Obtuse external surfaces 68, 69 and 70 lie between the chamfers or adjoining same. The chamfer 67 is the largest and extends as far as the panel underside 24. The chamfers are produced by machining with a single milling tool. The milling tool used virtually incorporates the illustrated stepped contour 64 of the free end of the lower groove wall 35. Panels can be produced in that way in different panel thicknesses, wherein the possible panel thicknesses are appropriately so selected that the respective panel underside is in the region of one of the chamfers 65, 66 or 67, that affords the stepped contour 64.

It will be appreciated that the configuration of the cross-sections of the tongue profile and the groove profile shown in FIG. 11 can also be provided for a thinner panel. It can for example be of a panel thickness corresponding to the panel in FIG. 10. The panel underside would then be disposed within the stepped contour 64 at a level of the bevel 65. The slot 63 is omitted when that small panel thickness is involved.

LIST OF REFERENCES

1 panel edge
1' panel
2 panel edge
2' panel
3 join
4 large edge break
4' large chamfer
5 small edge break
5' small chamfer
6 wedge-shaped projection
7 counterpart surface
8 obtuse butting surface
9 counterpart butting surface
10 wedge-shaped gap
10' tip of the gap
11 panel surface
12 panel surface
13 separate locking element
14 panel core
15 panel core
16 receiving hook
17 hook edge
18 receiving recess
19 arresting hook
20 arresting shoulder
21 arresting recess
22 holding surface
23 holding surface
24 panel underside
25 shoulder underside
26 shoulder surface
27 bottom (receiving recess)
28 material recess
29 latching means
30 latching recess
31 overlap
32 groove profile
33 tongue profile
34 upper groove wall
35 lower groove wall
36 holding edge
37 holding surface
38 groove bottom
39 holding surface
40 tongue underside
41 shoulder surface
**41*a*** distal end
**41*b*** proximal end
42 contact surface
43 tongue top side
44 contact surface
**44*a*** distal end
**44*b*** proximal end
45 internal surface
46 rise
47 free space
48 free space
49 free space
50 carrying surface
51 support surface
52 relief portion
52' relief surface
53 entry opening
54 upper wedge surface
55 lower wedge surface
56 rise
57 holding edge
58 edge surface
59 concave contour
60 free space
61 free space
62 free space
63 slot
64 stepped contour
65 chamfer
66 chamfer
67 chamfer
68 obtuse external surface
69 obtuse external surface
70 obtuse external surface
A upper portion
B lower portion
D spacing
G bottom
H hook profile
M central axis
S dash-dotted line α angle
β angle
γ pivotal angle

The invention claimed is:

1. A panel comprising a panel core, a panel surface, a panel underside and at least one edge pair of mutually opposite complementary panel edges provided with complementary locking means, wherein the complementary locking means are of such a configuration that in the assembled state of two of those panels beneath a visible join by means of the assembled complementary locking means both a locking action of the panel edges is achieved in a direction perpendicular to the panel surface and also a locking action is achieved to prevent the panels from moving apart from each other within the panel plane in a direction perpendicular to the locked panel edges, with the proviso that the panel edges provided with the complementary locking means have an upper portion and a lower portion in relation to the thickness of the panel, wherein the complementary locking means are arranged and formed in the lower portion of the panel edges, wherein the upper portion of the panel edges is provided for the formation of the upper join region including the visible part of the join and for that purpose the upper portion at each panel edge of the edge pair has an edge break which in the assembled state of two of said panels forms a recessed join, wherein the edge breaks of the complementary panel edges are of different sizes in the upper portion of the panel edges, and in the assembled state of two complementary panel edges the larger edge break is covered by the smaller edge break, wherein an obtuse butting surface is provided at a lower end of the larger edge break, wherein provided in the upper portion of the panel edges at that panel edge having the smaller edge break is a counterpart obtuse butting surface that cooperates with the obtuse butting surface provided beneath the larger edge break so that the obtuse butting surface is held in contact with the counterpart obtuse butting surface in the assembled state of two interlocked panels, wherein the obtuse butting surface and the counterpart butting surface are so arranged that in the assembled state of two complementary panel edges a wedge-shaped gap is formed between the obtuse butting surface and the counterpart butting surface, such that a tip of the wedge-shaped gap faces vertically upwardly towards the panel surface and is located at the lower end of the larger edge break, wherein the obtuse butting surface and the counterpart butting surface are in contact at the tip of the wedge-shaped gap.

2. The panel according to claim 1 wherein the panel edge having the smaller of the two edge breaks has beneath that smaller edge break an undercut counterpart surface for the covered part of the larger edge break.

3. The panel according to claim 1 wherein the counterpart butting surface is of such a configuration that in its upper region it is provided with an oversize so that in the assembled state pressing against the obtuse butting surface of the complementary panel edge can be achieved with the upper region of the counterpart butting surface.

4. The panel according to claim 1 wherein the wedge-shaped gap has a wedge angle in the region of 0° to 10° and a central axis of the wedge-shaped gap, that halves the wedge angle, is either arranged perpendicularly to the panel surface or is arranged in an angle range of ±5° relative to the perpendicular to the panel surface.

5. The panel according to claim 4 wherein the wedge-shaped gap has a wedge angle in the region of 1° to 5°.

6. The panel according to claim 1 wherein in the lower portion of the complementary panel edges the complementary locking means are in the form of complementary hook profiles, namely an upwardly open receiving hook and a downwardly open arresting hook, that both complementary hook profiles have holding surfaces provided integrally on the panel core and by means of which the locking action to prevent the panels moving apart within the panel plane away from each other in a direction perpendicular to the locked panel edges can be achieved and that there is provided a separate locking element for the locking action in the vertical direction perpendicular to the panel surface.

7. The panel according to claim 6 wherein the separate locking element is mounted at one of the complementary panel edges and has a latching means with which it is latchable in a latching recess of the complementary panel edge.

8. The panel according to claim 1 wherein provided in the lower portion of the complementary panel edges are locking means including a groove profile and a complementary tongue profile, the groove profile and the complementary tongue profile have holding surfaces, by means of which the locking action preventing the panels from moving apart within the panel plane away from each other in a direction perpendicular to the locked panel edges can be achieved and the tongue profile at its tongue top side has a contact surface and the groove profile at an upper groove wall has a complementary internal surface whereby in the assembled state the locking action can be achieved in the vertical direction perpendicular to the panel surface.

9. The panel according to claim 8 wherein the lower groove wall projects distally from the panel edge further than the upper groove wall, a holding edge is provided at the free end of the lower groove wall and the holding surface for the locking action to prevent the panels moving apart in the panel plane is provided at the holding edge.

10. The panel according to claim 8 wherein the groove profile and the tongue profile are adapted for a snap locking action in which locking is effected by level displacement of two identical panels with the panel edges perpendicularly towards each other and/or are so adapted that a panel is lockable to an identical panel by a pivotal movement, in that the panel is fitted in an inclined plane relative to the panel plane of the identical other panel and the tongue profile is lockable by subsequent pivotal movement of the inclinedly fitted panel into the plane of the other panel with its groove profile (pivotal locking).

11. The panel according to claim 8 wherein one of the holding surfaces for the locking action to prevent level movement of the panels apart is arranged at the lower groove wall of the groove profile and said holding surface is disposed in the region of the lower longer groove wall which extends distally over the length of the upper groove wall, said holding surface is in the form of an inclined plane which drops towards the groove bottom of the groove profile and the holding surface of the tongue profile, that is complementary to the holding surface of the groove profile, at the tongue underside, is also an inclined plane which in the assembled state bears in surface relationship against the holding surface of the groove profile.

12. The panel according to claim 8 wherein the groove profile and the tongue profile are adapted for pivotal locking, provided at the tongue underside is a flat lower shoulder surface oriented parallel to the panel surface, and the groove profile at a lower groove wall has a contact surface for the shoulder surface of the tongue profile, wherein the contact surface is also flat and parallel to the panel surface.

13. The panel according to claim 12 wherein the contact surface on the tongue top side is parallel to the panel surface and the complementary internal surface of the upper groove wall of the groove profile is arranged parallel to the panel surface.

14. The panel according to claim 8 wherein the contact surface of the tongue top side has a distal end and a proximal end and likewise the shoulder surface of the tongue underside has a distal end and a proximal end and that a spacing is provided between the distal end of the shoulder surface and the proximal end of the contact surface (pivotal connection).

15. The panel according to claim 8 wherein the lower groove wall rises out of the plane of the contact surface towards the groove bottom.

16. The panel according to claim 8 wherein the groove profile and the tongue profile are adapted for snapping locking, wherein at its tongue underside the tongue profile proximally has a lower shoulder surface and has a carrying surface distally and near the free end of the tongue profile, the complementary groove profile has a support surface for supporting the carrying surface of the tongue profile at the lower groove wall, and the complementary groove profile is provided with a matching contact surface for the lower shoulder surface of the tongue profile.

17. The panel according to claim 16 wherein the carrying surface of the tongue profile and the associated support surface of the groove profile are arranged parallel to the panel surface and the support surface is disposed in a region of the lower groove wall, that is opposite to the upper groove wall.

18. The panel according to claim 16 wherein the free end of the tongue profile is in the form of an obtuse wedge-shaped cross-section and the wedge surface at the tongue top side and also the wedge surface at the tongue underside create space.

19. The panel according to claim 18 wherein the wedge surface at the tongue underside is larger and provides a larger relief portion than the wedge surface at the tongue top side.

20. The panel according to claim 16 wherein the holding edge at the free end of the lower groove wall is provided with an edge surface and the edge surface is arranged on a level which for a snapping locking action makes it possible to slidingly move the tongue underside of a complementary panel over the edge surface and in so doing to bring the tongue top side of the tongue profile into contact with the relief portion at the inside of the upper groove wall.

21. The panel according to claim 16 wherein the tongue underside has a concave contour between its carrying surface and its shoulder surface, and in the assembled state of two panels a free space is formed between the concave contour of the tongue underside and the lower groove wall.

22. The panel according to claim 16 wherein provided beneath the groove bottom of the groove profile in the region of the proximal end of the lower groove wall at the panel underside is a slot extending parallel to the panel edge.

23. The panel according to claim 8 wherein the contact surface provided on the groove profile for the lower shoulder surface of the tongue profile is disposed in the region of the lower groove wall, that projects distally further from the panel edge in relation to the upper groove wall.

24. The panel according to claim 23 wherein the contact surface provided for the lower shoulder surface of the tongue profile on the groove profile is flat and is provided with an inclination directed downwardly in the distal direction in the region of 2° to 10° with respect to the panel plane or panel surface.

25. The panel according to claim 8 wherein the contact surface at the tongue top side is arranged parallel relative to the panel surface, wherein the internal surface complementary thereto of the upper groove wall of the groove profile is also arranged parallel to the panel surface, and the internal surface of the upper groove wall is larger than the support surface at the lower groove wall.

26. The panel according to claim 25 wherein the center of the internal surface of the upper groove wall is arranged closer to the groove bottom than the center of the support surface of the lower groove wall.

27. The panel according to claim 8 wherein at the inside of the upper groove wall the groove profile has a cut-free relief portion towards its free end and the relief portion is such that the width of the groove increases towards the free end.

28. The panel according to claim 8 wherein in the assembled state of two complementary panel edges at least three pairings of contact surfaces are formed in the lower portion of the complementary panel edges in the assembled state of two panels, a contact surface pairing is formed from the contact surface of the tongue top side paired with the internal surface at the upper groove wall of the groove profile, and at least one second contact surface pairing is formed from the shoulder surface of the tongue underside paired with the contact surface of the lower groove wall of the groove profile, and in the assembled state of two panels a free space is formed between each of the three contact surface pairings.

* * * * *